US005091075A

United States Patent [19]

O'Neill et al.

[11] Patent Number: 5,091,075

[45] Date of Patent: Feb. 25, 1992

[54] REFORMING PROCESS WITH IMPROVED VERTICAL HEAT EXCHANGERS

[75] Inventors: Patrick S. O'Neill; Elias G. Ragi, both of Williamsville; Thomas J. Godry, Tonawanda, all of N.Y.

[73] Assignee: UOP, Des Plaines, Ill.

[21] Appl. No.: 549,324

[22] Filed: Jul. 6, 1990

[51] Int. Cl.[5] ..... C10G 35/06

[52] U.S. Cl. ..... 208/134; 208/135; 208/136; 208/137; 208/138; 208/139; 208/140; 208/141; 208/142; 165/133

[58] Field of Search ..... 208/134, 135, 136, 137, 208/138, 139, 140, 141, 142; 165/133

[56] References Cited

U.S. PATENT DOCUMENTS

| | | | |
|---|---|---|---|
| 3,760,168 | 9/1973 | Boyd | 208/134 |
| 4,119,526 | 10/1978 | Peters et al. | 208/64 |
| 4,409,095 | 10/1983 | Peters | 208/134 |
| 4,431,522 | 2/1984 | James, Jr. | 208/134 |
| 4,440,626 | 4/1984 | Winter et al. | 208/65 |
| 4,615,792 | 10/1986 | Greenwood | 208/134 |
| 4,700,771 | 10/1987 | Bennett et al. | 165/1 |
| 4,769,511 | 9/1988 | O'Neill | 585/715 |

*Primary Examiner*—Helane E. Myers

*Attorney, Agent, or Firm*—Thomas K. McBride; John G. Tolomei

[57] ABSTRACT

A process for the reforming of hydrocarbons is improved by the use of an enhanced nucleate boiling surface in a selected portion of the feed effluent heat exchanger. In a vertical type heat exchanger where the reforming feedstream enters at a lower end of the heat exchanger and is at least partially vaporized in the heat exchanger by contact with a reforming effluent stream that enters an upper end of the heat exchanger and is at least partially condensed therein, an enhanced nucleate boiling surface is formed on the heat exchange surface that is in contact with the entering liquid phase portion of the stream feed. The enhanced nucleate boiling surface increases the amount of condensing that takes place on the opposite side of the heat exchange surface in a boiling-condensing zone. The use of the enhanced nucleate boiling surface in the boiling zone of the heat exchanger not only improves the heat transfer coefficient on the boiling side of the tube wall surface, but also the overall heat transfer on the opposite condensing side of the tube wall surface. The addition of the enhanced nucleate boiling surface provides a substantial increase in the overall heat exchange and the overall heat transfer coefficients for the heat exchanger.

13 Claims, 4 Drawing Sheets

REFORMING PROCESS WITH IMPROVED VERTICAL HEAT EXCHANGERS

BACKGROUND OF THE INVENTION

1. Field of the Invention

This invention relates to the field of reforming hydrocarbons in the presence of a reforming catalyst. More specifically, this invention relates to heat exchange between a reforming feedstream and a reforming effluent stream in a reforming process.

2. Discussion of the Prior Art

Catalytic reforming is a well-known process used in petroleum refineries to increase the octane number of straight run distillates (naphthas) by promoting chemical reactions which reduce the paraffin content and increase the content of aromatics and isoparaffin fractions. The desired chemical reactions are carried out over a catalyst at temperatures in excess of 900° F., and in the most common processes, at pressures less than 150 psi. In a typical reformer a hydrotreated naphtha with a 380° F. end point is mixed with a recycle gas which is rich in hydrogen and heated by indirect heat exchange with gaseous products from the reactor in a feed-effluent exchanger. About 30–40% of the heat transferred goes to vaporize the liquid feed. After the combined feed leaves the feed-effluent exchangers it enters a preheater that raises the feed to the desired reactor temperature.

The major reactions that occur in the reformer are the dehydrogenation of naphthenes to form aromatics, the dehydrocyclization of paraffins to form aromatics, the isomerization of paraffins, and the hydrocracking of higher boiling fractions to form paraffins in butane. The dehydrogenation and dehydrocyclization reactions are endothermic and evolve hydrogen. These reactions are favored by reduced pressure, reduced space velocity and high temperature. The paraffin isomerization reaction is slightly endothermic and is not significantly influenced by pressure in the reforming zone. The hydrocracking reactions are undesirable exothermic reactions that are favored by increased pressure and low space velocity. Due to the nature of the above reactions, it is desirable to operate the process at as a low a pressure as possible. Lower pressures, however, increase the amount of coke deposited on the catalyst thereby reducing its effectiveness. Coking problems can be reduced by increasing the ratio of hydrogen to hydrocarbons in the feed or by using more coke-tolerant catalyst. Further information on reforming processes may be found in U.S. Pat. Nos. 4,119,526; 4,409,095 and 4,440,626.

Proper heat recovery in the feed effluent exchanger is important to the efficiency of product recovery in the reforming process. After the reaction occurs, the hot effluent exchanges heat with the feed by first cooling to the dewpoint and then partially condensing. The higher the feed outlet temperature to the preheater, the less fuel must be burned to maintain reactor temperature. Also, the more condensation that occurs in the effluent stream in the exchanger, the less downstream cooling must be provided to separate the reformate from the recycle gas.

It has been difficult by conventional methods to increase the outlet temperature of the reforming feedstream or the amount of condensation that occurs in the effluent stream. The typical approach of a person skilled in the design of feed effluent changers, when attempting to decrease the temperature difference between the feed leaving and the effluent entering the heat exchanger, is to increase the heat recovery or capacity of the existing system by adding surface area, either in the form of longer exchangers or additional units in parallel. Both approaches are costly and have technical disadvantages. Firstly, increasing the exchanger length would result in additional pressure drop that translates to increased recycle gas compressor power and reduced delivery pressure to downstream processes. Secondly, the addition of extra tubes, either as larger diameter exchangers or more units in parallel, would result in lower fluid velocities since the total stream is split into more paths. The resulting lower velocities would in turn lead to lower heat transfer coefficients which would work against the addition of surface area and also increase the likelihood of undesirable maldistribution of the 2-phase feedstream at the inlet. Finally, the designer would face the problem of reduced available temperature difference between the feed and effluent streams. Each increment in heat recovery gained by the addition of ordinary surface area results in a reduction of the temperature difference. Accordingly, the designer is confronted with an approaching temperature pinch and declining heat transfer coefficients with lower velocities and would likely conclude that exorbitant amounts of additional bare tube surface area must be added to gain a very modest increase in heat recovery and, therefore, is not practical or feasible.

It is known in the art that the surface of heat exchanger tubes can be treated to promote nucleate boiling. Such nucleate boiling surfaces can promote dramatic increases in the boiling film coefficients that are associated with heat transfer tubes in a boiling heat exchange zone. Such enhanced boiling surface for heat exchange tubes are discussed in U.S. Pat. Nos. 3,384,154; 3,821,018; 4,064,914; 4,060,125; 3,906,604; 4,216,826 and 3,454,081. Such surfaces have been known to provide benefits to a variety of processes. For example, a significant improvement in the refrigeration of an alkylation effluent by the use of an enhanced boiling surface is taught in U.S. Pat. No. 4,769,511. Such nucleate boiling surfaces have been known to increase boiling film coefficients by a factor of 10 or more.

It is an object of this invention to increase the heat transfer between a reforming feedstream and a reforming effluent stream.

It is a further object of this invention to reduce the temperature differential between an existing reforming feedstream that is exchanged with an entering reforming effluent stream.

A further object of this invention is to increase the feed processing capacity of a reforming process while maintaining the same feed outlet temperature and effluent inlet temperature and the same surface area in a feed effluent heat exchanger.

BRIEF SUMMARY OF THE INVENTION

In this invention a reforming process is improved by the use of an enhanced nucleate boiling surface in a feed effluent exchanger of the reforming process. The nucleate boiling surface is used in a boiling-condensing zone of the heat exchanger where an enhanced section of the heat exchange surface vaporizes a liquid phase component of the feedstream and the opposite of the heat exchange surface is condensing the effluent stream. The improvement to the process uses an enhanced nucleate boiling surface to increase the boiling film coefficient in that section of the heat exchange zone where boiling of the liquid phase feed components occurs. The improved heat recovery in the boiling zone of the heat exchanger has the unexpected result of causing the effluent stream that is cooling and partially condensing on the opposite side of the heat exchange surface to undergo additional condensation. This additional condensation takes place under conditions that promote high heat transfer coefficients, thereby resulting in a significant additional overall benefit to the performance of the heat exchanger.

The effluent begins to condense not when its bulk vapor temperature reaches the dewpoint but when the tube metal temperature is at the dewpoint. Since heat transfer coefficients for partial condensing in the presence of a high thermal conductivity gas, such as hydrogen, are substantially higher than those of pure cooling, the net result is additional improvement in the zone overall heat transfer coefficient beyond that due to improved boiling performance alone. In other words, the enhanced nucleate boiling surface facilitates improved heat transfer on the opposite tube wall surface as a result of the reduction in the tube metal temperature.

The resulting improvement in boiling and condensing heat transfer reduces the size required for the boiling section of the heat transfer zone and thus permits more of the available surface area to be used in gas heating. As a result, higher outlet feed temperatures are achieved at constant feed rates, reactor temperatures, and exchanger geometry. Alternately, the improved heat transfer performance from the enhanced boiling surface can be used to operate the reforming process at a higher throughput while maintaining the same outlet temperatures, reactor temperature, and exchanger geometry. Therefore, by the addition of a small amount of an enhanced nucleate boiling surface, a significant improvement in the total heat recovery from the feed effluent exchanger can be obtained. The improvement in heat recovery can be 10% or more. Such a large recovery would not be feasible by merely adding additional bare tube surface.

The use of the enhanced nucleate boiling surface can benefit the process in many and different ways. Existing exchanger bundles in a feed effluent exchanger can be replaced with new bundles that use the enhanced boiling surface to thereby provide closer temperature approaches and increase the vaporized feed outlet temperature. Increasing the vaporized feed outlet temperature would result in energy savings by reducing the amount of make-up fuel which must be burned to heat the feed to the desired reactor temperature. Increasing the vaporized feed outlet temperature can also eliminate the need to modify or replace the old fired preheaters that are used to raise the temperature of the reforming feed to the final reactor temperature. Alternately, the enhanced nucleate boiling surface in the lower portion of the heat exchanger can be used to permit an increase in feed rate, and thus capacity, of the exchanger for a given feed inlet and outlet temperature without increasing the surface area or adding exchangers to the process. In either case, the improved results are attained without additional heat exchange surface area exchanger length which has the benefit of not increasing the pressure drop in the exchanger section of the process. The recovery of additional heat from the effluent stream also has the advantage of condensing additional effluent material thereby reducing the amount of further cooling that is needed on the reforming effluent stream.

Accordingly, in one embodiment, this invention is a process for reforming hydrocarbons that comprises contacting a reforming feed with a reforming catalyst in a reforming reaction zone to form a reforming effluent stream wherein heat from the reforming effluent stream is transferred to the reforming feedstream by indirect heat exchange in a vertical heat exchanger. The reforming feedstream enters a lower end of the heat exchanger and is vaporized in a lower section of the heat exchanger by contact with a first heat exchange surface and the reforming effluent stream enters an upper end of the heat exchanger and is condensed in a lower portion of the heat exchanger. The process is improved by contacting the reforming feedstream with an enhanced nucleate boiling surface formed on the first heat exchange surface. The addition of the enhanced nucleate boiling surface increases the effectiveness of the condensing heat transfer in the lower portion of the heat exchanger.

In another embodiment, this invention is a process for reforming hydrocarbons that comprises combining a liquid phase reforming feedstream and a hydrogen-rich recycle gas to form a combined reforming feed, and passing the combined reforming feed into the tube side and to the bottom of a vertically-oriented tube and shell heat exchanger to heat and vaporize the feed. The vaporized feed is passed to a reforming reaction zone and contacted therein with a reforming catalyst to form a gas phase reforming effluent stream that is passed to the top of the heat exchanger to transfer heat from the reforming effluent stream to the reforming feedstream by indirect heat exchange in the heat exchanger. At least a portion of the reforming effluent stream is condensed in a lower portion of the heat exchanger. This invention improves the process by contacting the reforming feedstream with an enhanced nucleate boiling surface formed on at least the inside and lower portion of the tubes in the heat exchanger to increase the effectiveness of boiling and condensing heat transfer in the lower portion of the heat exchanger.

Other objects, embodiments and details of this invention are described in the following detailed description.

DETAILED DESCRIPTION OF THE INVENTION

This invention is generally directed to improving the operation of a reforming process. The improvement is obtained by a change to the operation of the main heat exchanger in the reforming process which is referred to as the feed effluent exchanger. It is desirable to the successful practice of this invention that the feed effluent exchanger to which this improvement is applied is a vertical type heat exchanger. An essential feature of this invention is the use of an enhanced nucleate boiling surface on the portion of the exchanger in which the reforming feedstream undergoes boiling to produce a vaporized feedstream. Another essential feature of this invention is the partial condensation of the reactor effluent stream on the opposite side of the heat exchange surface upon which boiling of the feedstream is effected. In such exchangers it has been surprisingly discovered that the overall heat transfer coefficient of an integral vertical shell tube heat exchanger can be improved by as much as 10–20% by the simple addition of the enhanced nucleate boiling surface to that portion of the heat exchanger tubes in which boiling of the feed takes place. Although it is known that enhanced nucleate boiling surfaces can provide significant increases in the heat transfer coefficient in a boiling heat transfer zone, such a large increase in overall improvement was unexpected. It is believed that the large increase is the result of enhancing the nucleate boiling surface on a portion of the heat exchange tube that is undergoing condensing/cooling on the opposite side of the same portion of the heat exchange tube. Because of the high heat transfer rates associated with the condensing of the reforming effluent stream on the opposite surface, the benefit from the enhanced nucleate boiling surface is greatly and unexpectedly increased.

Figure 1:
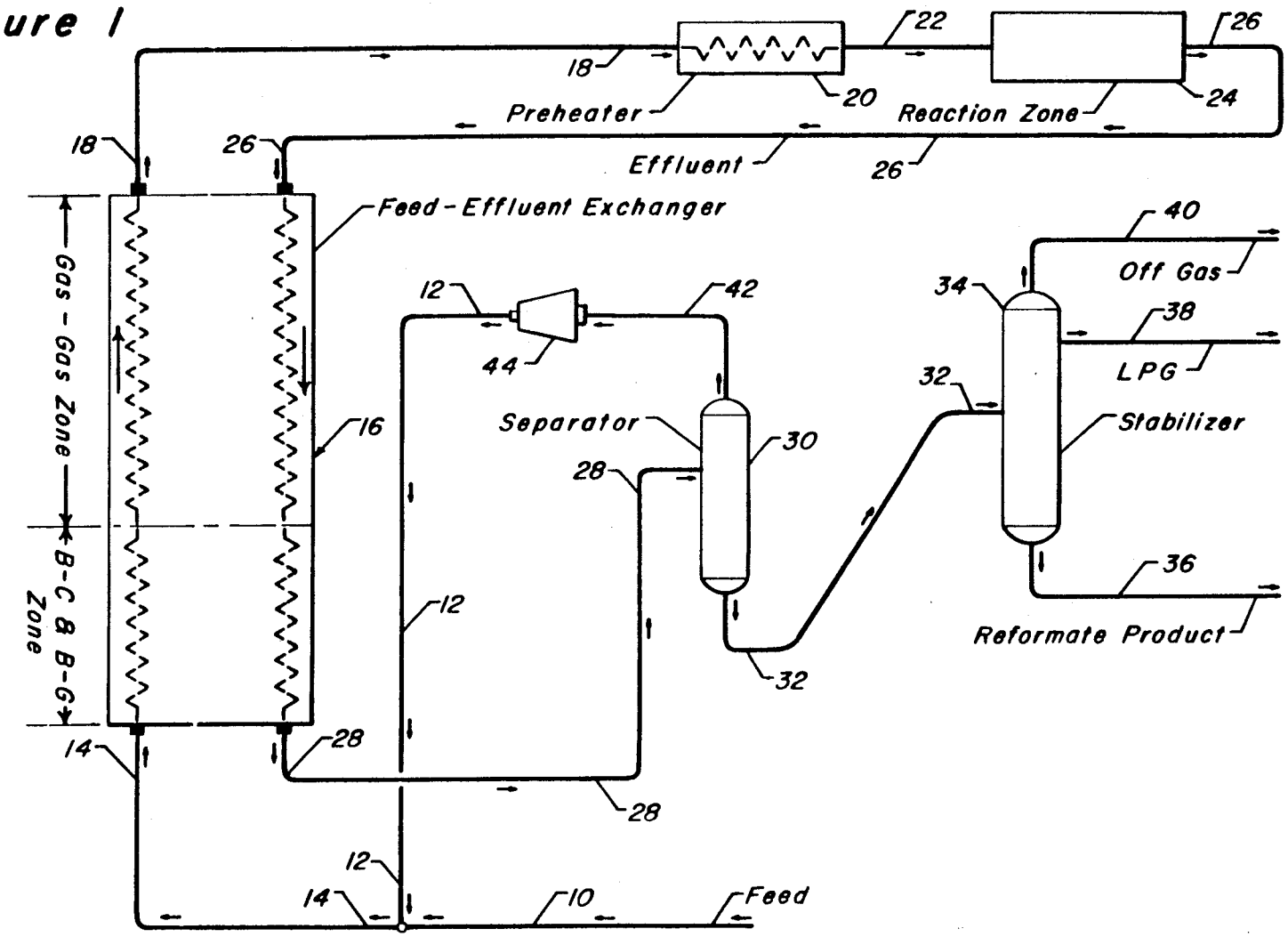
FIG. 1 is a simplified schematic flowscheme of a reforming process.

The operation of the reforming process can be more fully appreciated from FIG. 1. With reference to FIG. 1, a reforming feed enters the process through a line 10 and is combined with a recycle gas stream carried by a line 12 that consists primarily of hydrogen and light gases. The combined reforming feed is carried by a line 14 into the bottom of a feed effluent exchanger 16. The feed is heated in exchanger 16 to a temperature in excess of 800° F. and withdrawn from an upper end of the exchanger through a line 18. Line 18 carries the heated combined feed through a preheater 20 that heats the combined feed to the final reaction temperature, usually in excess of 900° F. Line 22 carries the heated combined feed from the preheater to a reactor section 24. After contact with a reforming catalyst, the combined feed forms a reactor effluent stream that is carried by a line 26 from the reaction zone to the feed effluent exchanger. The effluent is cooled and partially condensed against the combined feedstream in the feed effluent exchanger 16 and withdrawn from the bottom of the exchanger by a line 28. The cooled effluent from the feed effluent exchanger may be further condensed in a condensing unit not shown and then transferred to a separator 30. The liquid portion recovered in the separator, consisting of an aromatics-rich phase and an LPG portion, is transferred by a line 32 to a stabilizer 34 and further distilled to recover a reformate product taken by line 36, an LPG stream taken by line 38, and a light off-gas stream withdrawn through a line 40. A hydrogen-rich gaseous phase of the cooled reforming effluent stream is recovered overhead from separator 30 by line 42, passed through a compressor 44 to increase its pressure, and combined with the feed by a line 12 in the manner hereinbefore described.

The Figure represents a very simplified representation of a reforming process. The simple representation of the reforming process is not meant to be a limitation on the type of reforming process configurations in which this invention may be used. For example, it is common in reforming processes to use a series of reactors in a reaction zone with interstage heating between individual reactors. Likewise, a variety of arrangements for the separation of the reforming effluent stream are known. Accordingly, this invention may be used with any type of reaction zone and feed or product recovery facilities.

The operation and arrangement of the feed effluent exchanger is an important aspect of this invention. Suitable feed effluent exchangers for use in this invention will have a vertical orientation. FIG. 1 refers to three types of heat exchange within zones of the heat exchanger. These three types of heat exchange refer to the conditions on opposite sides of the heat exchange surface and include boiling-condensing (B-C) where boiling of the feed occurs on one side of the heat exchange surface, and partial condensing of the effluent occurs on the other side of the heat exchange surface, boiling-gas (B-G) where feed boiling occurs on one side of the heat exchange surface and heat is transferred from gas on the opposite side of the heat exchange surface, and gas-gas (G-G) heat exchange where there is gas present on both sides of the heat exchange surface. For the practice of this invention, the various zones of heat exchange can be provided in a series of heat exchangers. The exchanger must have sufficient length such that boiling of the feedstream and condensation of the effluent stream will occur in the same vertical section of the heat exchanger. It is preferred that at minimum the first effluent exchanger in such a series would have sufficient length for all of the boiling of the feed material to occur in a single vertical section. It is further preferred that the total heating and cooling of the reforming feed and reforming effluent stream be performed in one or more parallel vertical exchangers. Such exchangers are referred to as integral exchangers. Thus, it is preferred that the exchangers are integral and have sufficient heat exchange surface so that the reforming feed and reforming effluent enter or aliquot portions thereof and leave the same exchanger thereby causing boiling-condensation and gas-gas heat transfer to occur in the same heat exchanger.

Figure 2:
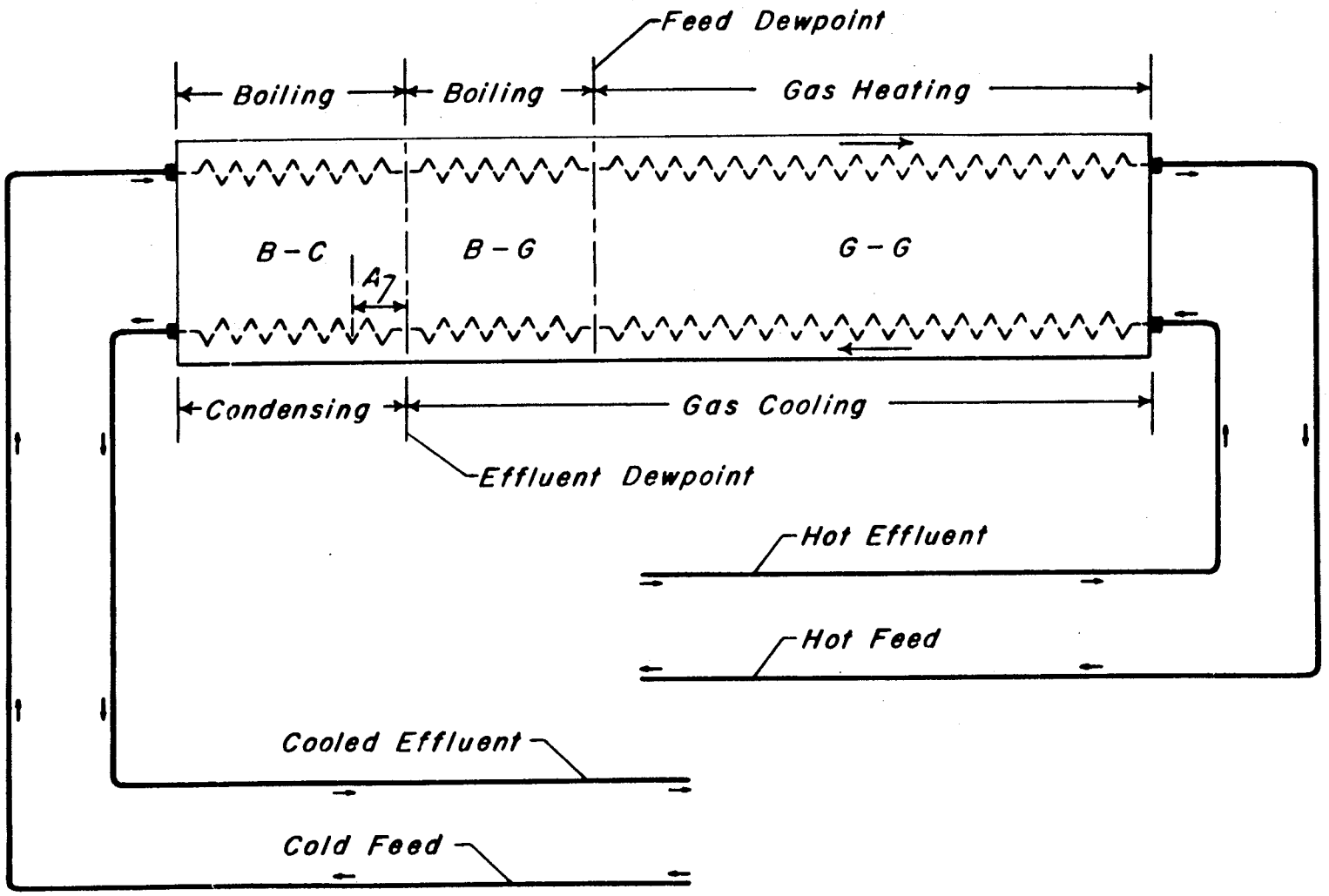
FIG. 2 is a schematic drawing of a feed effluent heater.

FIG. 2 shows the preferred embodiment of this invention where all of the heat transfer zones are contained in a single integral heat exchanger and further shows the relative location of such zones. The (B-C) zone is at the lowest section of the heat exchanger. In this section the temperature of the cold feed is essentially at its boiling point and localized boiling is occurring at the heat exchange surface that is in contact with the feedstream and the feed comprises a mixed phase fluid of gas and liquid. On the opposite side of the heat exchange surface, the reformer effluent is also present as a mixed phase fluid. Condensing of the reformer effluent occurs first on the heat exchange surface which has a temperature below the dewpoint of the reformer effluent stream. The division between the (B-C) zone and (B-G) zone is at the point where the heat exchange surface in contact with the reactor effluent stream has a temperature that is below the dewpoint of the reformer effluent stream. Note that the upper limit of the condensing zone is defined by the temperature of the heat exchange surface and not the average temperature of the reformer effluent stream therein. Consequently, in the upper end of the (B-C) zone, the reformer effluent will have an average temperature that is above its dewpoint, however, condensation will occur locally at the heat exchange surface which is below the temperature of the effluent dewpoint. At a lower point, in the (B-C) zone, the effluent stream temperature will drop to the point where it becomes saturated. This section is referred to as the condensing saturated vapor zone. A substantial advantage of this invention is that it provides a significant length (indicated by dimension A of FIG. 2) of condensing zone located below the point where the tube surface is below the effluent dewpoint line and above the condensing effluent saturated vapor zone. In the prior art practice of using bare tubes and reforming heat exchangers, there was little length (Dimension A) if any to such condensing zone and essentially all of the (B-C) zone contained condensing saturated vapor. With the use of the enhanced boiling surface of this invention, the length of the condensing zone that is free of saturated vapor will have a length that is equal to at least 10% of the total length of the (B-C) zone or at least 6 inches long. In many cases, the length of the condensing zone that is free of saturated reforming feed effluent vapor is on the order of 1 to 2 feet.

Above the (B-C) zone there is an additional zone of boiling that is shown in FIG. 2 as zone (B-G). This is a zone where boiling of the reforming feed occurs on one side of the heat exchange surface as a result of gas heating from the reforming effluent vapors on the opposite side of the heat exchange surface. This condition exists between the points in the exchanger where the heat exchange surface on the reforming effluent side of the heat exchanger is at the reforming effluent dewpoint, and the heat exchange surface on the reforming feed side of the heat exchange surface is at the temperature of the feed dewpoint.

The use of the enhanced nucleate boiling surface of this invention generally operates to reduce the overall combined length of zones (B-C) and (B-G) while reducing the relative length of zone (B-G) to zone (B-C). The reduced combined length of zones (B-C) and (B-G) is the result of the improved heat transfer coefficient in the boiling region that vaporizes the reforming feed more quickly. The reduced relative length of zone (B-G) to zone (B-C) is a particular advantage of this invention in that it provides a longer zone of the more efficient boiling condensing heat transfer as opposed to the less efficient boiling gas heat transfer.

Once the temperature of the heat exchange surface that is in contact with the reforming feed has reached the feed dewpoint, the rest of the heat transfer between the reforming feed and the reforming effluent is gas-gas heat transfer and is shown in FIG. 2 as zone (G-G). For a fixed length of exchanger, this invention has the advantage of providing a longer length for zone (G-G) by reducing the required combined length of zones (B-C) and (B-G).

Where an integral heat exchanger is used, the total vertical shell-tube length of such a unit can vary from 40 to 70 ft. This invention can be used in any type of vertical heat exchanger. Typically, the invention can be used in a plate-type heat exchanger and more commonly in a shell-and-tube type heat exchanger.

The addition of the enhanced nucleate boiling surface can be accomplished in a variety of ways. A number of patents related to such surfaces have been enumerated in the background of this invention. Typically, these enhanced nucleate boiling surfaces are incorporated on the tubes of a shell-and-tube type heat exchanger. These enhanced tubes are made in a variety of different ways which are well known to those skilled in the art. For example, such tubes may comprise annular or spiral cavities extending along the tube surface made by mechanical working of the tube. Alternately, fins may be provided on the surface. In addition the tubes may be scored to provide ribs, grooves, a porous layer and the like.

Generally, the more efficient enhanced tubes are those having a porous layer on the boiling side of the tube. The porous layer can be provided in a number of different ways well known to those skilled in the art. The most efficient of these porous surfaces have what are termed reentrant cavities that trap vapors in cavities of the layer through restricted cavity openings. In one such method, as described in U.S. Pat. No. 4,064,914, the porous boiling layer is bonded to one side of a thermically conductive wall. The porous boiling layer is made of thermally conductive particles bonded together to form interconnected pores of capillary size having equivalent pore radius of less than about 6.0 mils, and preferably less than about 4.5 mils. As used herein, the phrase "equivalent pore radius" empirically defines a porous boiling surface layer having varied pore sizes and non-uniform pore configurations in terms of an average uniform pore dimension. Such an enhanced tube containing a porous boiling layer is commercially available under the tradename High Flux Tubing made by UOP, Des Plaines, Ill.

An essential characteristic of the porous surface layer is the interconnected pores of capillary size, some of which communicate with the outer surface. Liquid to be boiled enters the subsurface cavities through the outer pores and subsurface interconnecting pores, and is heated by the metal forming the walls of the cavities. At least part of the liquid is vaporized within the cavity and resulting bubbles grow against the cavity walls. A part thereof eventually emerges from the cavity through the outer pores and then rises through the liquid film over the porous layer for disengagement into the gas space over the liquid film. Additional liquid flows into the cavity from the interconnecting pores and the mechanism is continuously repeated.

When using an enhanced boiling surface other than a porous layer, the boiling film heat transfer coefficient is typically increased by a factor of about 4 or more to a value of at least about 400 (Btu/hr/ft$^2$° F. By utilizing this enhanced boiling surface, containing a porous boiling layer, the boiling film heat transfer coefficient of the boiling fluid within the tubes can be increased by a factor of about 10, typically to a value of 700 (Btu/hr/ft$^2$° F.) or more. This is due to the fact that the heat leaving the base metal surface of the tube does not have to travel through an appreciable liquid layer before meeting a vapor-liquid surface producing evaporation. Within the porous layer, a multitude of bubbles are grown so that the heat, in order to reach a vapor liquid boundary, need travel only through an extremely thin liquid layer having a thickness considerably less than the minute diameter of the confining pore. Vaporization of the liquid takes place entirely within the pores.

Figure 3:
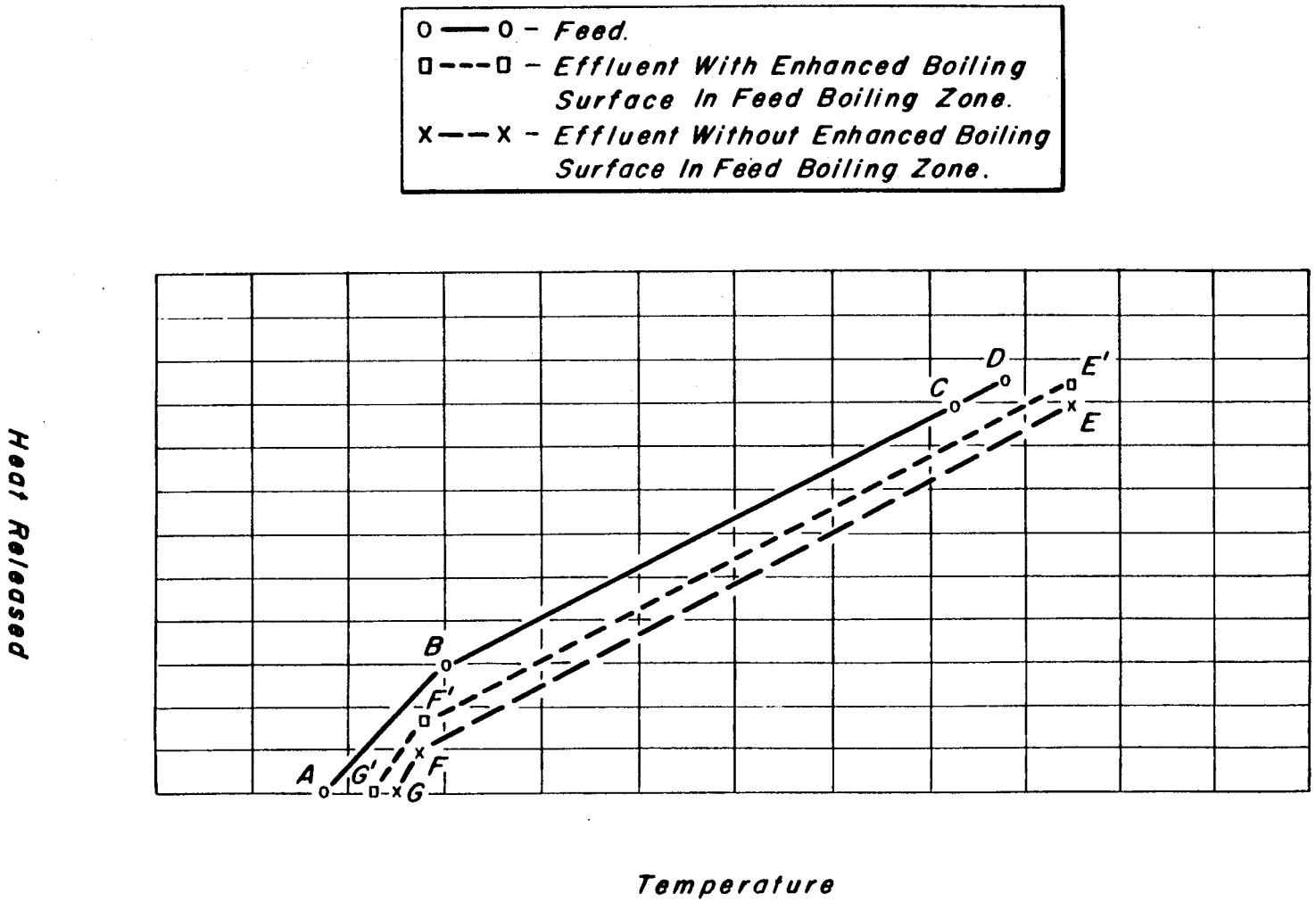
FIGS. 3 and 4 are heat release curves (also referred to as heating and cooling curves.)

The surprising benefit of adding the enhanced nucleate boiling surface in the boiling zone of the feed effluent heat exchanger can be more fully appreciated by the heat release curve shown in FIG. 3. FIG. 3 provides a comparison of the enhanced and bare tubes at fixed exchanger geometry feed flow rate and reactor temperature. The higher feed outlet temperature that is obtained by this invention results in a reduction in the overall temperature difference for heat transfer. FIG. 3 illustrates the mechanism for this reduction. The curve, A, B, C, represents the heat released to the feed in an exchanger that does not use the enhanced nucleate boiling surface of this invention. Feed enters at point A and vaporizes to the dewpoint B. With the use of bare tubes, gas leaves the exchanger at point C. Again, for the case of a bare tube heat exchanger, curve G, F, E, represents the heat released from the reformer effluent stream. The effluent enters the exchanger at point E and begins to release heat to the feedstream. Eventually, it reaches the effluent dewpoint, point F. Partial condensing then occurs below point F until the point G where the reformer effluent is removed from the exchanger. Additional partial condensing may also occur along the region defined by points E and F where the tube metal temperature is below the dewpoint of the reactor effluent stream.

When an enhanced boiling surface is used, there is additional length in the gas-gas heat exchange zone as represented by that portion of the heat release curve between point C and D. Accordingly, the extra heat recovered by the feedstream in this invention is represented by segment C, D. Since the effluent always has the same inlet temperature, and the mass flow rate for the reformer effluent is the same as the feed, a new heat release curve for the effluent stream is shown by the dotted line in FIG. 3. The heat release curve that is representative of this invention begins above the bare tube heat release curve G, F, E at a point E'. It is apparent that the overall temperature difference between the feed and effluent has decreased relative to the bare tube case and that the condensing zone G' to F' has increased in heat load relative to the condensing zone for the bare tube case represented by segment G, F. The upper displacement of heat release curve G', F', and E', demonstrates the major reason why conventional feed effluent heaters are difficult to improve in terms of heat recovery since an increment in heat recovery is matched by a reduction in available temperature difference. A key feature of this invention is that it overcomes some of this handicap by promoting improved heat transfer coefficients in the condensing zone which tend to compensate for the reduced temperature difference across the heat exchanger and conditions approaching a "pinch", i.e., where curve G, F, E moves upward until it approaches line A, B, C to a point where no further heat recovery is possible.

As FIG. 3 demonstrates, the method of this invention offers significant heat recovery advantages. As briefly mentioned in the summary of the invention, this improved heat removal capacity can be used to either obtain an improved end point temperature for the reforming feedstream as it leaves the heat exchanger or to increase the capacity of an existing exchanger. There are several possibilities when the invention is used to increase the throughput or capacity of the exchanger. In such alternatives, existing system pressure drop is a major consideration. For systems that currently have a low pressure drop, the use of enhanced tubes can increase the overall heat transfer coefficient about 40%. Therefore, at fixed stream temperature differences the capacity can be increased by 40% with equal size exchangers and with only a doubling of the pressure drop.

The improved feed effluent heat exchangers that use the enhanced nucleate boiling service of this invention can be used in both new or existing plant environments. The most useful application would be in the retrofit or replacement of existing tube bundles for shell and tube heat exchangers to improve the operation of process conditions.

In addition to adding the enhanced nucleate boiling surface, other enhancement of the heat exchange surfaces in different heat transfer zones of the exchanger may also be used. For example, other surfaces can be added in the condensing zone to further promote condensing of liquid on the tube surface. Known methods for enhancing a condensing surface include the use of a "sand grain" surface that has large heat conductive particles on the heat exchange surface to provide local cold spots that will initiate condensation. Other enhancements that can be used would be in the gas heat transfer zones. Some examples of known enhancements include twisted tape inserts or low fin tubing, each of which increase the heat exchange surface for the transfer of sensible heat in the gas zones. Such additional enhancement surfaces would increase the overall heat transfer capability of the exchanger and further increase heat recovery without changing any of the benefits of the enhanced nucleate boiling surface as discussed above.

Whether the enhanced nucleate boiling surface is used in old or new heat exchangers, there are few restrictions on its application. The only essential element of the invention is that the enhanced nucleate boiling surface be provided in the boiling zone of the heat exchanger. The boiling zone in the corresponding enhanced nucleate boiling surface can be used on most types of heat exchange surfaces. In the case of a shell-and-tube type heat exchanger, the enhanced nucleate boiling surface may be placed on either the inside or outside of the tubes. However, it is generally preferred to place the enhanced nucleate boiling surface and have boiling occur on the inside of the tubes in a vertical shell-and-tube type heat exchanger. Also, the enhanced nucleate boiling surface should extend throughout the entire boiling zone to obtain maximum benefit from the invention. This means that in a typical heat exchanger tube, approximately the first 40% of the tube will be coated with the enhanced nucleate boiling surface. Most enhanced nucleate boiling surfaces will not interfere with heat transfer in the gas heat transfer zone above the boiling zone. Therefore, the enhanced nucleate boiling surface should be extended upward through to what is considered the maximum distance that the boiling zone can extend. In this regard the entire reformer feed side of the heat exchanger may be provided with the enhanced nucleate boiling surface. It does appear that there may be some small heat transfer advantages to providing the enhanced nucleate boiling surface over the entire length of the heat exchanger on the reforming feed side of the heat transfer surface, if cost considerations are disregarded.

EXAMPLE

The following example illustrates the potential benefits gained by application of the invention in replacement of the feed-effluent exchangers in a 35,000 bpd catalytic reformer with tubes containing a High Flux boiling surface in the lower boiling zone portion. This example is based in part on computer simulations and engineering calculations that are derived from operating units. The existing system which is representative of the prior art operates with 2 shell-tube feed-effluent exchangers in parallel, and a flow scheme similar to FIG. 1. Each exchanger in the existing system has 3,000 bare tubes that are 40 ft. in length and ¾ in. in diameter. The nucleate boiling surface of this invention was provided by adding 2 new exchangers each containing 3000, ¾ in. diameter tubes. All the tubes are 40 ft. long and the High Flux boiling surface is applied to the bottom 16 ft. of the tube interior.

The High Flux surface substantially increases the overall heat transfer coefficient in the boiling zone. The High Flux exchangers were calculated to have an overall U-value for the entire exchanger of about 60 Btu/hr/ft$^2$/F. The existing exchangers in operation had overall measured heat transfer coefficients of about 35 Btu/hr/ft$^2$/F. and expected or calculated values of about 50, which is typical of vertical exchanger performance in various units of this type.

Heat transfer coefficients for the bare tube exchangers have been calculated using well-known procedures familiar to heat exchanger designers. The large difference between the calculated and measured heat transfer values for the existing exchangers is due to differences between the theoretical and actual environment in the heat exchanger which has a major impact on the convective heat transfer coefficients for the existing tubes. The overall heat transfer coefficient for the existing exchangers is controlled in large part by these convective heat transfer coefficients. The calculated overall heat transfer coefficient for the tubes that use the High Flux surface is more reliable since the High Flux coefficient is not dependent on convective coefficients and, therefore, not greatly influenced by changes in flow regime High Flux exchangers were simulated with procedures modified to correct for the heat transfer effects herein described.

A summary of the operating conditions for the existing exchangers and High Flux exchangers is shown in Table 1. The naphtha and recycle gas feed enter the tube side at the bottom with the liquid portion comprising about 84% by weight of the combined feed, and at a temperature of 180° F. Four cases were considered in this example. The simulated performance is shown in column 1 for the case of High Flux tubing and the 35,000 bpd feed rate. Simulated and observed performance for the bare tube exchanger case at the 35,000 bpd feed rate appears in columns 2 and 3. Column 4 illustrates a case for increased capacity where the feed rate is raised from 35,000 to 50,000 bpd, while maintaining terminal temperatures similar to column 2.

Referring again to Table 1, the overall heat transfer coefficients for the High Flux case are 44 and 90, respectively, in the gas-gas and boiling zones, and the overall total value is 58. The bare tube values, based on observed performance are 33 and 39 in the gas and boiling zones and 35 overall. The contribution of the High Flux surface, depending on whether case 2 or 3 is considered, increases the boiling zone coefficient from 1.6 to 2.6 fold beyond the bare tube value.

Figure 4:
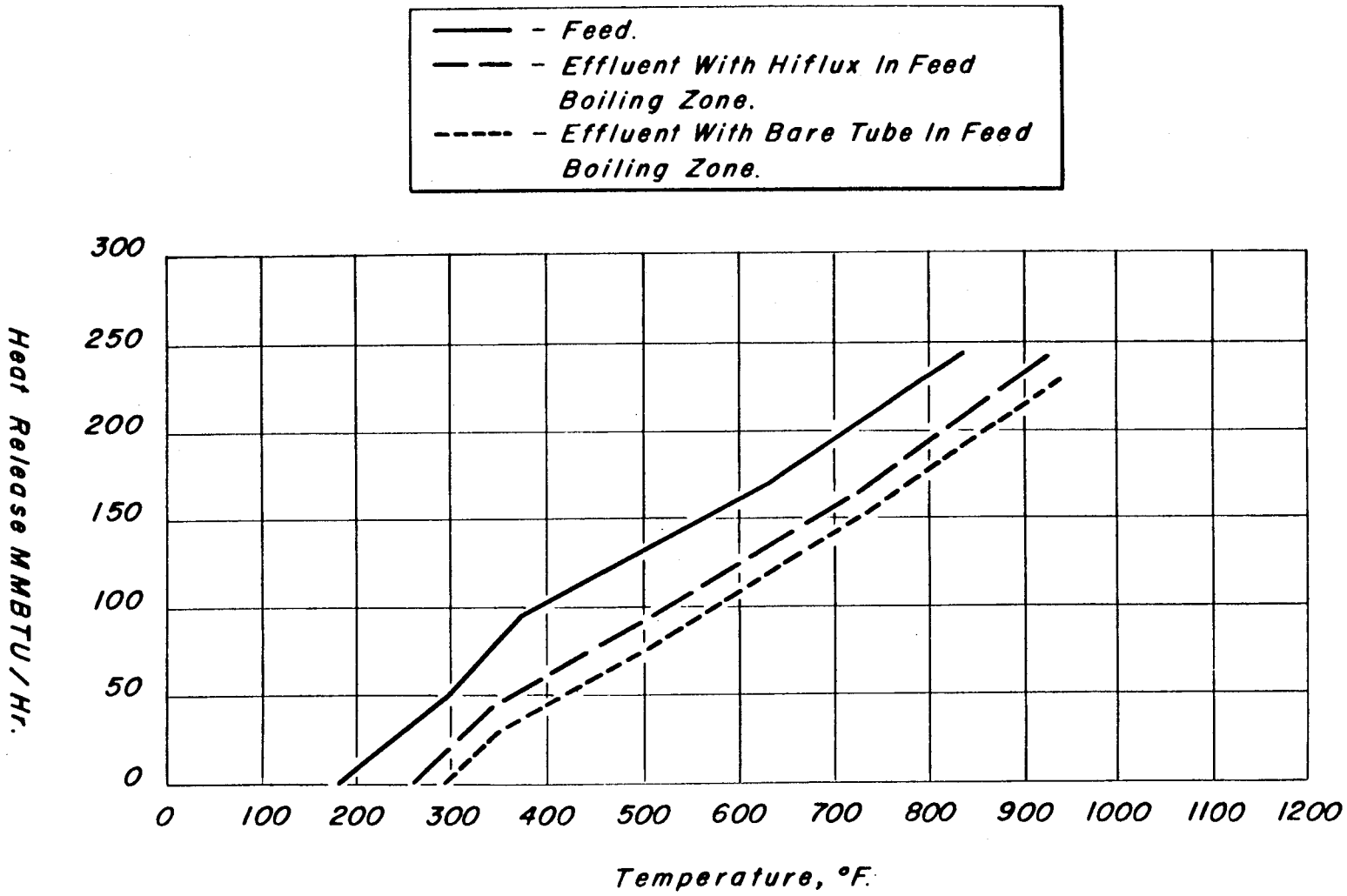

FIG. 4 shows the heat release curves for the High Flux example, and for comparison, the effluent cooling curve expected when the replaced bare tube exchangers exhibited the observed performance. The region between the 2 effluent curves represents the additional recovered heat with the enhanced boiling surface retrofit.

The total heat transferred is also shown in Table 1. After the exchanger replacement, about 245 million Btu/hr are recovered, while values of 227-240 are recovered in the bare tube cases. The difference between these values represents the fuel savings. It is apparent that the use of a High Flux surface on only the lower part of the tubes saved at least 5 and most probably 18 million Btu/hr. If preheat fuel is worth $4/MMBtu, then the annual fuel saving ranges from $170,000 to $600,000.

TABLE 1

| | Case 1 High Flux Revamp 35,000 B/D | Case 2 Bare Tube Observed Operation | Case 3 Bare Tube Expected Operation | Case 4 High Flux Capacity Increase |
|---|---|---|---|---|
| Total Flowrate lb/hr | 427,000 | 427,000 | 427,000 | 605,700 |
| Percent Liquid Feed Inlet | 84 | 84 | 84 | 84 |
| Percent Liquid Effl. Out | 39 | 25 | 35 | 36 |
| Reformer Capacity B/D | 35,000 | 35,000 | 35,000 | 50,000 |
| Inlet Feed Temp. °F. | 180 | 180 | 180 | 180 |
| Outlet Feed Temp. °F. | 848 | 800 | 834 | 834 |
| Inlet Effluent Temp. °F. | 930 | 930 | 930 | 930 |
| Outlet Effluent Temp. °F. | 260 | 293 | 270 | 270 |
| Feed Dewpoint °F. | 371 | 371 | 371 | 371 |
| Effluent Dewpoint °F. | 346 | 346 | 346 | 346 |
| H.T Coeff. Btu/hr/ft$^2$/F | | | | |
| Boiling Film | 750 | 135 | 130 | 900 |
| Gas Zone Overall | 44 | 33 | 44 | 55 |
| Boiling Zone Overall | 90 | 39 | 55 | 110 |
| Overall, Exchanger | 58 | 35 | 50 | 70 |
| Surface Area ft$^2$ Total | 46,200 | 46,200 | 46,200 | 46,200 |
| Heat Transferred MMBtu/hr | 245.4 | 227.9 | 240.0 | 340.4 |
| Boiling Zone Length ft. | 12 | 16 | 16 | 12.4 |
| Condensing Zone Length ft. | 8.3 | 6+ | 8+ | 8.7 |
| Saturated Vapor Condensing Zone Length ft. | 6.3 | 6 | 8 | 6.0 |

We claim:

1. In a process for reforming hydrocarbons comprising contacting a reforming feedstream with a reforming catalyst in a reforming reaction zone to form a reforming effluent stream wherein heat from the reforming effluent stream is transferred to the reforming feedstream by indirect heat exchange in a vertical heat exchange zone, the reforming feedstream is passed to a lower end of the vertical heat exchange zone and at least partially vaporized in said heat exchange zone, the reforming effluent stream is passed to an upper end of the vertical heat exchange zone and at least partially condensed in said heat exchange zone and boiling of said feedstream and condensing of said effluent stream occurs in a lower portion of said heat exchange zone, the improvement comprising contacting said reforming feedstream with an enhanced nucleate boiling surface in a lower portion of said heat exchange zone and maintaining said contact of the feedstream with said nucleate boiling surface above the point in said vertical heat exchange zone where boiling of said feedstream occurs to increase the effectiveness of the condensing heat transfer in said heat exchanger.

2. The process of claim 1 wherein said enhanced nucleate boiling surface is a High Flux boiling surface and said feedstream contacts a layer of reentrant openings in said lower portion of said vertical heat exchange zone.

3. The process of claim 1 wherein boiling, condensing and gas-gas heat transfer occurs in said vertical heat exchange zone.

4. The process of claim 3 wherein said feedstream contacts said nucleate boiling surface for at least half the length of said vertical heat exchange zone.

5. The process of claim 1 wherein said reforming feed has a higher dewpoint than said reforming effluent.

6. The process of claim 5 wherein said reforming feed is vaporized and reforming effluent is condensed in a boiling-condensing section of said vertical heat exchange zone and said boiling-condensing section includes an upper portion that does not contain saturated reforming effluent vapors.

7. The process of claim 6 wherein said upper portion extends for an average length of at least 6 inches.

8. In a process for reforming hydrocarbons comprising combining a liquid phase reforming feedstream and hydrogen to form a combined reforming feed having a first dewpoint, passing the combined reforming feed into the bottom of a vertically oriented, heat exchange zone to heat and vaporize the feed, passing the vaporized feed to a reforming reaction zone, and contacting said vaporized feed with a reforming catalyst in said reforming reaction zone to form a gas phase reforming effluent stream having a second dewpoint that is lower than said first dewpoint, passing said gas phase effluent stream to the top of said heat exchange zone, and transferring heat from the reforming effluent stream to the reforming feedstream by indirect heat exchange in said heat exchange zone to at least partially condense said effluent stream in a lower portion of the heat exchange zone, the improvement comprising contacting said reforming feedstream with an enhanced nucleate boiling surface formed on a concave portion of a heat exchange surface in said heat exchange zone and extending upward from the bottom of said heat exchange zone past the point in said heat exchange zone where boiling of said feedstream occurs to increase the effectiveness of the boiling and condensing heat transfer in the lower portion of the heat exchange zone.

9. The process of claim 8 wherein said enhanced nucleate boiling surface is a High Flux boiling surface and said feedstream contacts a layer of reentrant openings in said vertical heat exchange zone.

10. The process of claim 8 wherein at least 30 wt. % of said reforming effluent stream is condensed in said heat exchange zone.

11. The process of claim 8 wherein the reforming feedstream boils and the reforming effluent stream is condensed in a boiling-condensing section of said heat exchange zone and said section has a lower portion containing saturated reforming effluent vapor and an upper portion that is relatively free of saturated reforming effluent vapor.

12. The process of claim 11 wherein said upper portion extends for a length equal to at least 10% of the total length of the boiling-condensing section.

13. The process of claim 11 wherein said upper portion extends for a length of at least 6 inches.

* * * * *